US006431903B1

(12) United States Patent
Dittmann et al.

(10) Patent No.: US 6,431,903 B1
(45) Date of Patent: Aug. 13, 2002

(54) INSULATION DISPLACEMENT CONTACT FOR USE WITH FINE WIRES

(75) Inventors: Larry E. Dittmann, Middletown; Christopher W. Shelly, Hummelstown, both of PA (US)

(73) Assignee: Y-connect Incorporated, Middletown, PA (US)

( * ) Notice: Subject to any disclaimer, the term of this patent is extended or adjusted under 35 U.S.C. 154(b) by 0 days.

(21) Appl. No.: 09/800,920

(22) Filed: Mar. 7, 2001

(51) Int. Cl.[7] ..... H01R 11/20
(52) U.S. Cl. ..... 439/395
(58) Field of Search ..... 439/404–406, 439/409, 941, 395

(56) References Cited

U.S. PATENT DOCUMENTS

| | | | | |
|---|---|---|---|---|
| 4,136,920 | A | | 1/1979 | Scholtholt et al. |
| 4,293,177 | A | | 10/1981 | Weisenburger |
| 4,600,259 | A | | 7/1986 | Olsson |
| 4,662,699 | A | | 5/1987 | Vachhani et al. |
| 4,722,699 | A | | 2/1988 | Heng et al. ..... 439/396 |
| 4,902,241 | A | | 2/1990 | Lockard ..... 429/395 |
| 4,921,436 | A | | 5/1990 | Sole et al. ..... 439/395 |
| 4,932,891 | A | | 6/1990 | Spanke et al. ..... 439/395 |
| 4,975,077 | A | | 12/1990 | Kato et al. ..... 439/395 |
| 5,282,758 | A | | 2/1994 | Onoue ..... 439/395 |
| 5,492,484 | A | | 2/1996 | Archer ..... 439/395 |
| 5,554,048 | A | | 9/1996 | Martins ..... 439/406 |
| 5,588,859 | A | | 12/1996 | Maurice ..... 439/290 |
| 5,616,047 | A | | 4/1997 | Lutsch ..... 439/397 |
| 5,836,782 | A | | 11/1998 | Odley et al. ..... 439/397 |
| 5,938,479 | A | * | 8/1999 | Paulson et al. ..... 439/941 X |
| 6,142,817 | A | * | 11/2000 | Lee ..... 439/395 |

* cited by examiner

*Primary Examiner*—Brian Sircus
*Assistant Examiner*—Son V. Nguyen
(74) *Attorney, Agent, or Firm*—Barley Snyder

(57) ABSTRACT

The disclosure relates to an electrical contact in which the thickness of the stock material is greater than the width of an insulation displacement slot provided therein. The contact is manufactured utilizing conventional stamping and forming operations to create an insulation displacement slot which could not be previously manufactured using these techniques. The contact has a wire receiving section and a mounting section integrally attached to the wire receiving section. Thinned areas are coined or formed on either side of the insulation displacement slot, thereby causing the width of the insulation displacement slot to be dimensioned to receive and terminate the fine wires therein.

9 Claims, 4 Drawing Sheets

INSULATION DISPLACEMENT CONTACT FOR USE WITH FINE WIRES

FIELD OF THE INVENTION

The invention relates to a contact which utilizes insulation displacement technology. In particular, the invention is directed to the use of insulation displacement technology with fine wires.

BACKGROUND OF THE INVENTION

The use of insulation displacement contacts (IDC) technology is well known in the electrical connector industry. In general, a slot is provided in a contact which cooperates and terminates a respective wire. As the wire is moved into engagement with the slot, the edges of the slot cut through the insulation provided on the wire. The width of the slot is less than the width of the conducting core of the conductors so that as the conductor moves into the slot the edges of the slot contact the conductor to form the electrical contact therebetween.

Terminals of this type are well known in the industry and are widely used for wires having diameter of at least 0.33 millimeters (which is the equivalent of an AWG 28 WIRE), but they are not used to any significant extent for wires having a diameter of less than 0.33 millimeters. The reason that insulation displacement technology is not used for fine wires is that it is impractical to produce terminals having extremely narrow slots. Consequently, as narrow slots are difficult to produce, the electrical connection between the terminals and fine wires is not assured. For example, the slot required for a wire having a diameter of about 0.2 millimeters must have a width of about 0.1 millimeter. Utilizing conventional die and punch technology, this size slot is extremely difficult to manufacture.

The wire-receiving slots are produced in the sheet metal from which the terminals are manufactured by means of conventional punch and die techniques. In other words, a punch is provided having a width equal to the width of the slot and a die is provided having an opening into which the punch moves. The sheet metal is supported on the die; and when the punch moves into the die, the slot is formed. As a practical matter, it is not possible to produce slots using conventional stamping techniques in sheet metal of a given thickness which have a width which is significantly less than the thickness of the sheet metal. In other words, if the stock metal has a thickness of about 0.30 millimeters, it is impractical to punch a slot in the stock metal having a width which is much less than 0.30 millimeters. If a wire has a diameter of 0.20 millimeters, the slot width should be approximately 0.10 millimeters. As previously stated, a slot having this width cannot be produced using conventional stamping technology in stock metal having a thickness of 0.30 millimeters. This limitation on slot width exists because the narrow punch will break because of the extremely high stresses imposed on the punch when it moves against the stock metal. Alternatively, if the punch does not break, the high wear on the punch and the die will cause the edge of the slot to be deformed, thereby providing ineffective electrical connection between the conducting core of the wire and the electrical terminal.

It might appear that the terminals for extremely fine wires might be produced from extremely thin stock metal which would permit the formation of extremely narrow slots in the stock metal. However, if the stock metal used for the terminals is extremely thin, the resulting terminals will be flimsy and will be useless for that reason. In other words, if extremely thin stock is used, when the wire is moved into engagement with the slot, the thin metal stock will be deformed and the insulation of the conductor will not be displaced. As the insulation is not removed properly and as the width of the slot is not properly controlled, the conducting core of the wire will not be placed in electrical connection with the electrical terminal.

U.S. Pat. No. 4,600,259 discloses a contact for use with fine wire. The miniature electrical contacts are provided with closely-spaced thin plates which define there between lengthy passageways for receiving closely-spaced conductors of a wire or cable. Zones around the contact surface sections are coined to reduce their thickness such that the contact surface sections will engage and terminate the wire. This allows fine wires to be terminated such that the conducting cores are provided in electrical engagement with the electrical contacts.

The present invention is directed to the achievement of a terminal which is relatively inexpensive to manufacture and which provides the required integrity of the electrical contact to insure that an electrical connection will be made between the core conductors of the fine wire and the electrical contact. The electrical contact of the present invention is stamped and formed using conventional stamping technology. The slot is then made thinner by coining the edges of the slot in a controlled manner to allow material of the contact to flow into the slot, thereby providing a slot with the width appropriate to terminate fine wires.

SUMMARY OF THE INVENTION

The invention is directed to an electrical contact for terminating fine wires thereto. In other words, the invention is directed to an electrical contact in which the thickness of the stock material is greater than the width of an insulation displacement slot provided therein. The contact is manufactured utilizing conventional stamping and forming operations to create an insulation displacement slot which could not be previously manufactured using these techniques. Consequently, the invention eliminates the need to manufacture narrow slots by means of lasers and the like.

In particular the invention is directed to an electrical contact for terminating fine wire. The contact has a wire receiving section having an insulation displacement slot which extends from a top surface of the wire receiving section. The width of the slot is less than the thickness of the wire receiving section. Thinned areas are provided on either side of the insulation displacement slot, with the thinned areas being swaged or coined from the wire receiving section. Whereby the width of the insulation displacement slot is dimensioned to receive and terminate a respective fine wire therein.

The invention is also directed to a method of manufacturing an electrical contact to terminate fine wire. A blank of material is stamped to provide an initial slot, the initial slot having a width which is substantially equal to the thickness of the blank of material. Pressure is applied to each side of the initial slot, causing the material to flow into the initial slot. The flow of material is controlled to create an insulation displacement slot which has a width which is less than the thickness of the blank of material. The pressure is then removed from each side of the initial slot to create an insulation displacement slot which can terminate fine wire therein.

DETAILED DESCRIPTION OF THE INVENTION

With more particular reference to the drawings, the invention is directed to an electrical contact 2 which can be provided in a housing, mounted to a printed circuit board, or used in any other conventional manner. As the manner in which the contact is mounted or captured is not important with respect to the invention described and claimed herein, the particular housing, etc. in which the contact is mounted will not be described.

Figure 1:
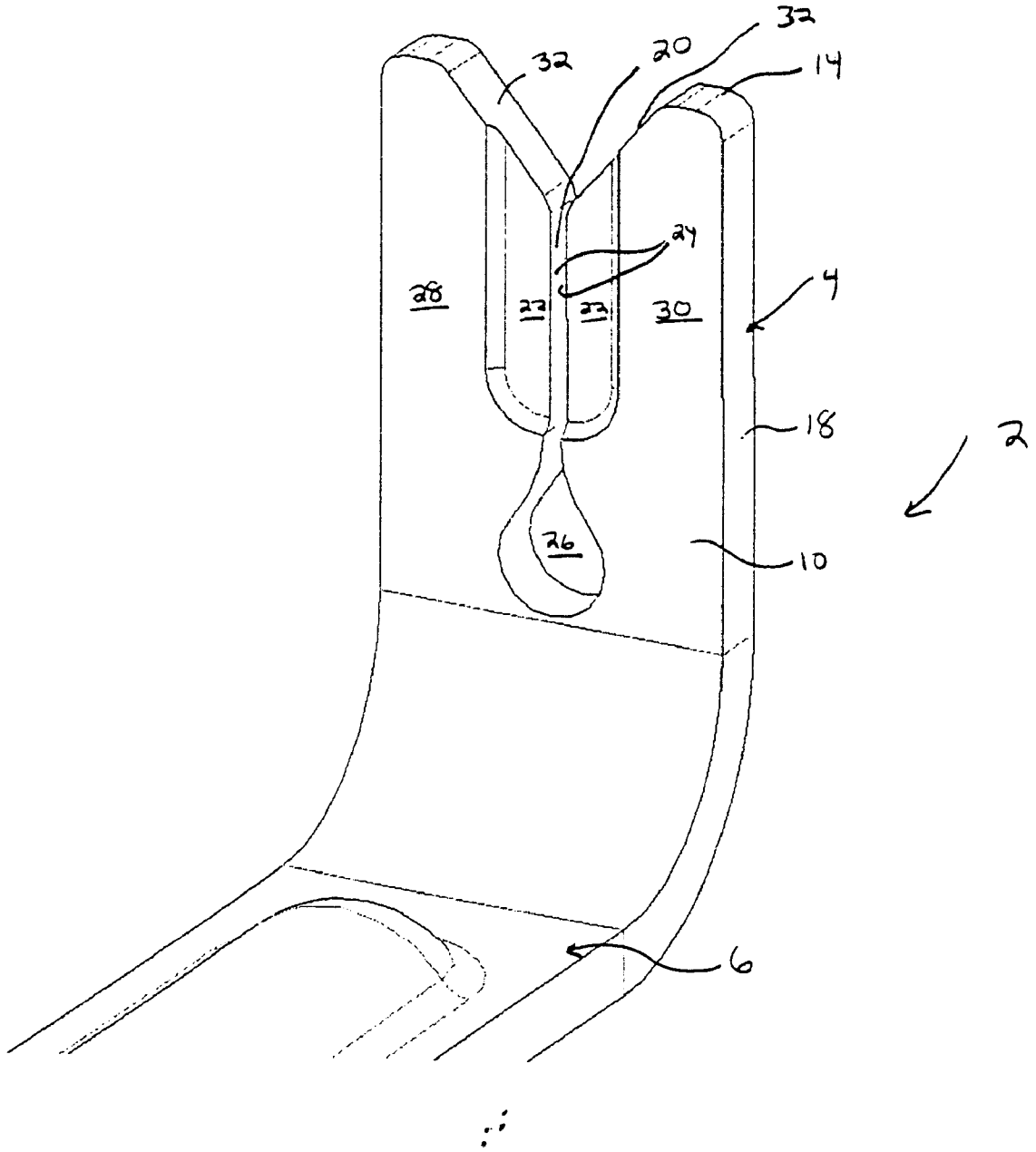
FIG. 1 is a partial enlarged perspective view of an electrical contact according to the present invention, showing the wire receiving section of the contact.

Referring to FIG. 1, in the embodiment shown electrical contact 2 is of one piece construction and is stamped and formed from 0.10 inch thick stock. Various different materials having the strength and electrical characteristics required can be used to manufacture the contact, including but not limited to stainless steel or copper-nickel-tin alloy. Each contact 2 has a wire receiving section 4 and a mounting section 6. In the embodiment shown in the figures, the mounting section 6 extends to a box contact which receives a mating contact therein. However, the mounting section can have various configurations depending on the particular application in which the contact is used.

Figure 2:
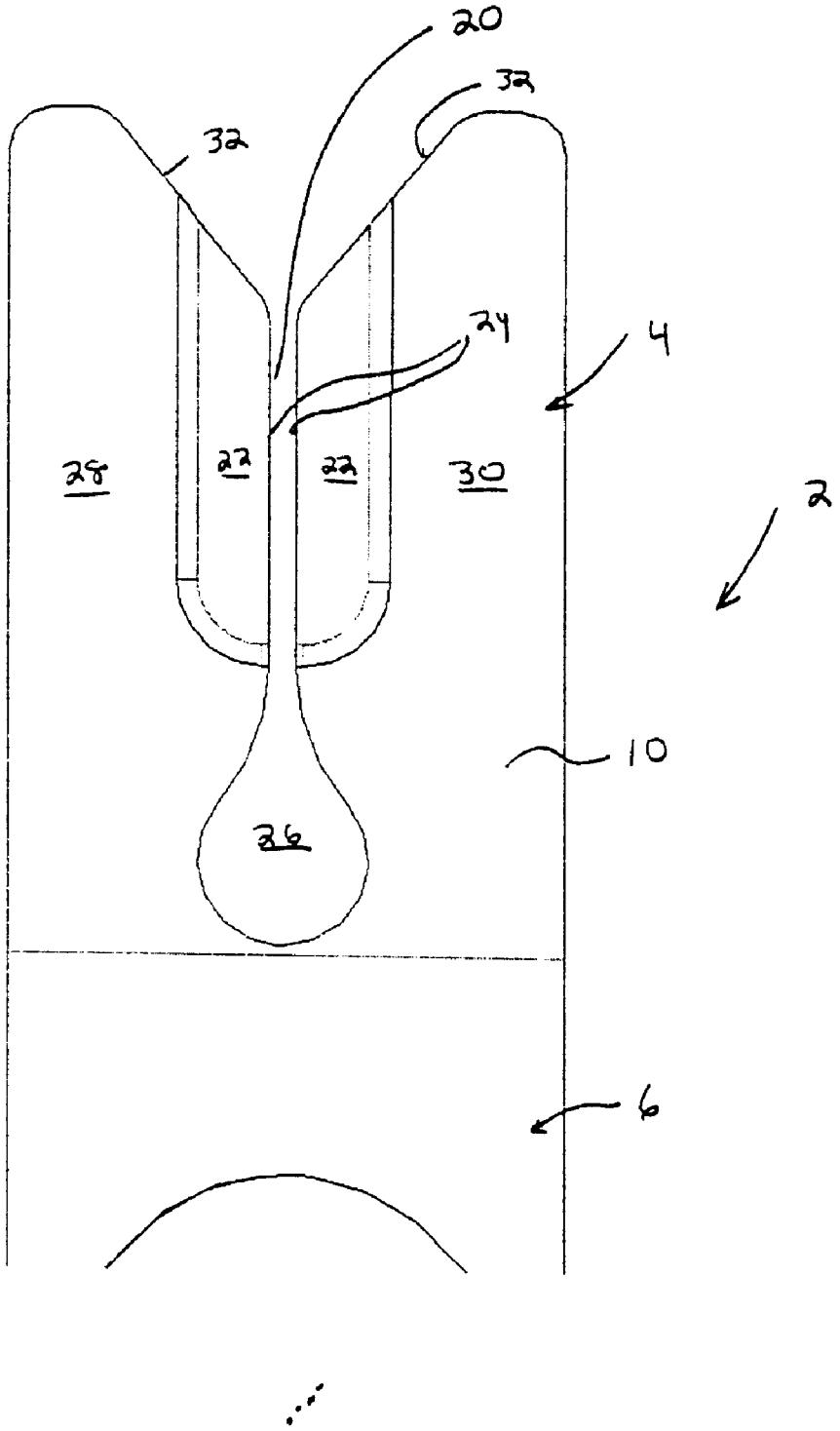
FIG. 2 is a partial enlarged front view of the electrical contact of FIG. 1 showing the wire receiving section of the contact.
Figure 3:
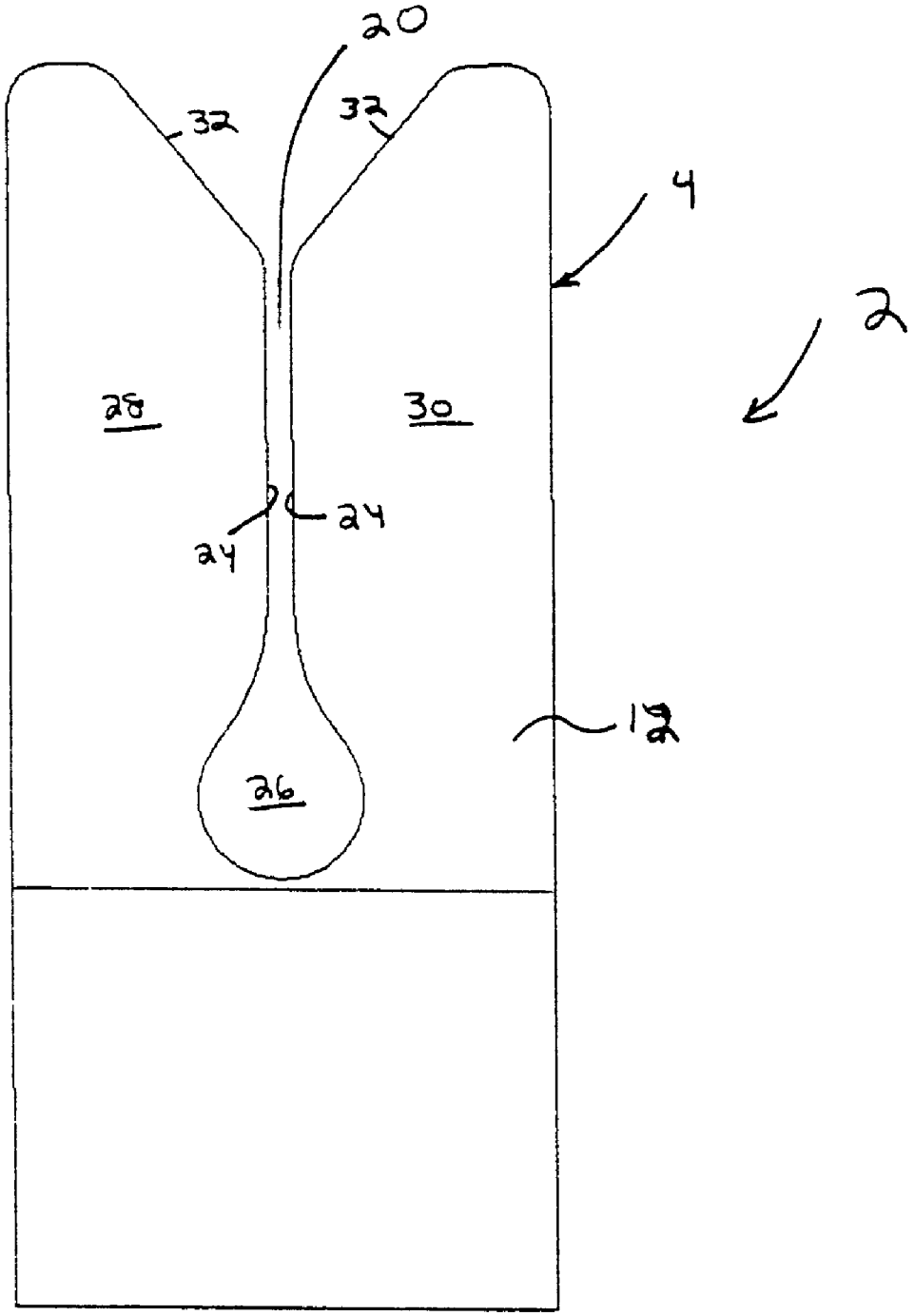
FIG. 3 is a partial enlarged rear view of the electrical contact of FIG. 1 showing the wire receiving section of the contact.

Referring to FIGS. 1 through 3, the wire receiving section 4 has a front surface 10, a back surface 12, a top surface 14 and side surfaces 18. The front surface 10 and back surface 12 are essentially parallel to each other. An insulation displacement slot 20 is provided in the wire receiving section 4 and extends through front and back surfaces 10, 12.

Insulation displacement slot 20 is provided along the longitudinal axis of the wire receiving section 4. As shown in FIG. 2, thinned areas 22 have edges 24 which are formed when the thinned areas are formed. These thinned areas 22 have been coined or swaged, as will be more fully discussed below. The use of the coined areas 22 allows the slot 20 to have a width which is dimensioned to receive fine wires (not shown) therein. In particular, the slot can be dimensioned to receive and terminate wires having a diameter of 0.04 inches or less. The areas 22, as shown in FIG. 4, are recessed from the front surface 10 and are in the same plane as back surface 12.

As is shown in FIGS. 1 through 3, opening 26 extends from slot 20 in a direction away from the top surface 14. The opening 26 cooperates with a bottom of the slot 20. The opening 26 allows members 28, 30 of wire receiving section 4 to be resiliently moved relative to each other. The dimension of the opening can be varied to adjust the resiliency of the members 28, 30. Generally, the larger the opening, the easier the members will move as wire is inserted into the slot. The dimensions of the opening 26 must be optimized to allow the wire to be inserted into the slot while insuring that sufficient normal forces will be applied by the members to maintain the electrical connection between the core conductor of the wire and the contact.

Lead-in surfaces 32 are positioned on the contact 2 and extend from the top surface 14 to the slot 20. The lead-in surfaces 32 are provided to guide the wire into the slot 20. As is shown in FIGS. 1–3, each lead-in surface has an essentially smooth surface, such that the wires will be easily transitioned to the slot 24. If sharp projections are provided on the lead-in surfaces 32, the wires may be prevented from reaching the slot 20.

Figure 4:
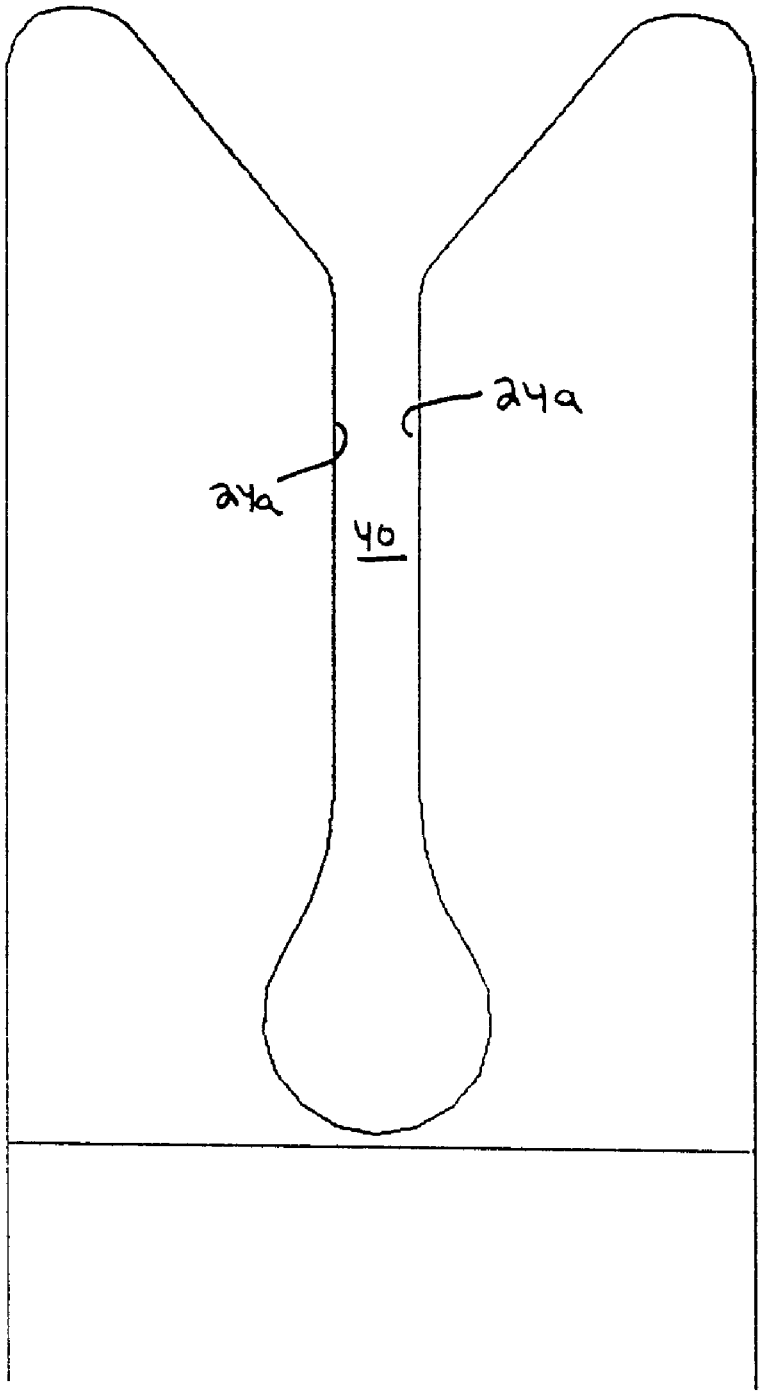
FIG. 4 is a plan view of the blank of the electrical contact of FIG. 1 after it has been stamped, but prior to it being coined.

Referring to FIG. 4, the contact is manufactured from stock material. In the embodiment shown, the blank is stamped from sheet metal having a thickness of about 0.10 inches. During the stamping process, an initial slot 40 is provided in the wire receiving section 4. The initial slot has edges 24*a*. As previously discussed in the background section, the slot 40 cannot, utilizing conventional stamping technology, have a width which is less that the thickness of the stock material. Consequently, when initially stamped, the slot 40 has a width which is essentially equal to the thickness of the stock material. This width of slot 40 is too large to terminate fine wires therein.

Therefore, after the stock material is stamped to form the contact blank shown in FIG. 4, the blank must be swaged or coined proximate the slot 40 to further reduce the width of the slot 40. The blank is positioned on a work surface of a press with back surface 12 properly supported. A ram is forced into engagement with the front surface 10 proximate the slot 40. Pressure is applied through the ram to the front surface 10 until material is extruded or flowed into slot 40. The pressure applied and the shape of the blank are precisely controlled to insure that the flow of material will also be controlled. During this controlled flow, the material moves into slot 40, causing edge 24*a* to move inward to create edge 24. After the appropriate pressure has been applied for the appropriate time, the ram is lifted and the contact is removed. The finished contact is configured as described above, with insulation displacement slot 20 dimensioned to receive a respective fine wire 50 therein.

The width of the slot 20 may vary according to the size of fine wire to be terminated therein. Consequently, the amount of pressure applied to the blank and the length of time the pressure is applied will vary to optimize the final result.

As was previously discussed, it is important that the lead-in surfaces 32 not have sharp projections provided thereon. Therefore, as the material is extruded, it is important that the direction of the flow of material be controlled. This is also important with the formation of slot 20. As with any insulation displacement slot, a minimum height h is required for the slot in order to insure that an electrical connection is effected. It is important in this area that the edges 24 be essentially uniform and positioned approximately parallel to each other. While the flow of material is partially determined by the pressure applied, the final configuration of the contact is also largely determined from the shape of the blank (FIG. 4) after it has been stamped.

With the contact stamped and formed according to the above description, a fine wire 50 is brought into engagement with the wire receiving 4 of contact 2. As the wire is inserted into the insulation displacement slot 20, the wire will exert pressure on the edges 24 of the slot 20, thereby causing the members 28, 30 to move in a direction away from each other. However, as the opening 26 controls the resiliency of the members 28, 30, the members 28, 30 will exert normal forces on the fine wire, thereby causing the edges 24 to penetrate the insulation of the fine wires and make a reliable electrical connection with the conductive core of the wire.

The invention as described herein allows fine wires to be terminated utilizing insulation displacement technology. The configuration of the contact allows the contact to be manufactured using conventional stamping technology, thereby eliminating the need for expensive, high technology solutions such as laser cutting and the like.

The foregoing illustrates just some of the alternatives for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. An electrical contact for terminating fine wire, the contact comprising:

a wire receiving section having an insulation displacement slot which extends from a top surface of the wire receiving section, the insulation displacement slot having opposed slot edges which penetrate insulation of the fine wire and make electrical connection to a conductive core of the fine wire;

thinned areas are formed on either side of the insulation displacement slot; the thinned areas are coined from the wire receiving section causing the opposed slot edges to be moved toward each other to narrow the insulation displacement slot;

whereby the coining allows the width of the insulation displacement slot to be narrowed from the initial slot originally stamped from the wire-receiving section to allow the insulation displacement slot to properly terminate the fine wire.

2. The electrical contact as recited in claim 1 wherein the thinned areas have a thinned area back surface which is in the same plane as a wire receiving section back surface and a thinned area front surface which is recessed from a wire receiving section front surface.

3. The electrical contact as recited in claim 1 wherein an opening is provided at the end of the insulation displacement slot which extends toward a bottom surface of the wire receiving section;

whereby the opening is dimensioned to provide side members of the wire receiving section the resiliency required to insure that the respective fine wire will make a reliable electrical connection with the electrical contact.

4. The electrical contact as recited in claim 2 wherein a pair of lead-in surfaces extend from the top surface proximate the insulation displacement slot.

5. The electrical contact as recited in claim 4 wherein each lead-in surface is a smooth surface which extends from a respective side member across a respective thinned area.

6. A method of manufacturing an electrical contact to terminate fine wire, having a conductive core surrounded by an insulative material, the method comprising the steps of:

stamping a blank of material to provide an initial slot, the initial slot having a width which is substantially equal to the thickness of the blank of material;

applying pressure to each side of the initial slot, causing the material to flow into the initial slot;

controlling the flow of material to create a final insulation displacement slot which has a width which is less than the thickness of the blank of material; and removing the pressure applied to each side of the initial slot;

whereby the width of the final insulation displacement slot is less than the thickness of the blank of material to allow the final insulation displacement slot to properly penetrate the insulative material and make a reliable connection with the conductive core.

7. The method of manufacturing the electrical contact as recited in claim 6 wherein thinned areas are formed where the pressure is applied, the thinned areas have a thinned area back surface which is in the same plane as a wire receiving section back surface and a thinned area front surface which is recessed from a wire receiving section front surface.

8. The method of manufacturing the electrical contact as recited in claim 7 wherein lead-in surfaces are stamped and formed in the blank of material, the lead-in surfaces extend from a top surface proximate the insulation displacement slot.

9. The method of manufacturing the electrical contact as recited in claim 6 wherein an opening is stamped into the blank of material, the opening is provided at the end of the initial slot, whereby the opening is dimensioned to provide side members of the wire receiving section the resiliency required to insure that the respective fine wire will make a reliable electrical connection with the electrical contact.

* * * * *